United States Patent [19]

Shevakin et al.

[11] 4,435,886

[45] Mar. 13, 1984

[54] PIPE-WELDING MILL FOR PRODUCTION OF COILED PIPES

[75] Inventors: Jury F. Shevakin; Igor I. Dobkin, both of Moscow; Efim M. Donskoi, Zheleznodorozhny; Grigory L. Manov, Moscow; Vasily V. Zhdanov, Moscow; Elena S. Berger, Moscow; Valery M. Popov, Sverdlovskoi; Alexei A. Pavlov, Sverdlovskoi; Rashid Z. Akchurin, Sverdlovskoi, all of U.S.S.R.

[73] Assignee: Gosudarstvenny Nauchnoissledovatelsky, Proektny I Konstruktorsky Institut Splavov I Obrabotki Tsvetnykh Metallov "Giprotsvetmetobrabotka", U.S.S.R.

[21] Appl. No.: 316,123

[22] Filed: Oct. 29, 1981

[51] Int. Cl.[3] ..... B21C 37/00; B21C 47/00

[52] U.S. Cl. ..... 29/33 D; 29/33 B; 72/145

[58] Field of Search ..... 29/33 D, 33 B; 72/129, 72/135, 145, 169

[56] References Cited

U.S. PATENT DOCUMENTS

| | | | |
|---|---|---|---|
| 1,023,099 | 4/1912 | Shuster | 72/145 |
| 1,137,412 | 4/1915 | Loutsel | 72/145 |
| 1,439,118 | 12/1922 | Peterson | 72/145 X |
| 2,196,600 | 4/1940 | Wean et al. | 29/33 B X |
| 2,339,424 | 1/1944 | Poole | 72/145 |
| 2,453,724 | 11/1948 | Payne | 72/145 |
| 2,959,849 | 11/1960 | Rubin | 29/33 D X |
| 3,074,465 | 1/1963 | Huet | 72/145 |
| 3,259,148 | 7/1966 | Keengel et al. | 29/33 D X |
| 3,348,394 | 10/1967 | Giros | 72/135 X |
| 3,548,624 | 12/1970 | Hann et al. | 72/129 |

*Primary Examiner*—Z. R. Bilinsky

*Attorney, Agent, or Firm*—Steinberg & Raskin

[57] ABSTRACT

A pipe-welding mill for production of coiled pipes from coiled strips comprises a coil preparation section including unwinders disposed in a manner allowing displacement thereof in a direction perpendicular to the direction of pipe movement, and a magazine including a reel with set-up coils, the mill further including a strip coupler, shaping, welding, and drawing stands, a coiling arrangement with bending rollers, and cutting and receiving arrangements, the components being successively installed in the direction of pipe movement. Guide or receiving rollers of the receiving arrangement are located on a platform installed in a manner allowing the platform tilt with respect to the axes of the bending rollers, the receiving rollers being connected to the output shaft of the drive of the bending rollers through a universal joint.

2 Claims, 4 Drawing Figures

PIPE-WELDING MILL FOR PRODUCTION OF COILED PIPES

BACKGROUND OF THE INVENTION

The present invention relates to production of pipes and in particular to pipe-welding mills for production of coiled pipes by argon-arc welding.

The pipe-welding mill forming the subject of the present invention may be used to advantage in production of welded thin-walled pipes wherein the ratio of an outside diameter to wall thickness is about 60, the welding being accomplished at a speed of 15 m/min approximately.

Known in the art is a pipe-welding mill for production of coiled pipes, comprising a strip preparation section including a coil magazine, an unwinder, a butt-welding device, shaping and sizing stands, a welding stand, a cutting arrangement, a guide system, differential switches, feeding machines, and winders (cf. "Equipment for Coiling Water and Gas Pipes Using a Continuous Furnace Welding Mill", UDC 621.774.21, Informtyazhmash SRI, 1-72-9, in Russian).

In the aforesaid mill the pipes may be coiled continuously by installing guide systems, differential switches for dividing the pipe flow between two winders, and feeding machines after the cutting arrangement, a feature substantially complicating its construction and entailing an intricate maintenance procedure.

Also used in pipe production in the USSR is a mill comprising a coil preparation section with two double-seat rotatable unwinders mounted on a platform disposed in a manner allowing its displacement in a direction perpendicular to the mill axis and with magazines containing coiled strip and mounted in the seats of the unwinders, a machine for coupling strip ends, shaping, welding, and drawing stands, a cutting arrangement, a guide for directing the pipe into bending rollers, feeding rollers, a coiling arrangement with two bending rollers having fixed axes and one bending roller having a movable axis, and also with a mechanism controlling the latter roller, a receiving arrangement with parallel rollers having a common drive with the bending rollers, the rollers of the receiving arrangement being rigidly attached to the output shafts of the drive, axes thereof being parallel to the axes of the bending rollers. Installed between the receiving rollers is a remover including a drive and grips.

However, the foregoing mill has been generally unsatisfactory due to intricate construction and a comparatively low operational reliability, a disadvantage associated with the fact that the cutting arrangement located ahead of the bending rollers of the coiling arrangement calls for the utilization of additional mechanisms such as a guide, feeding rollers, and a mechanism controlling the bending roller, said mechanisms being required to direct the forward end of the subsequent pipe into the bending rollers, to control the bending roller at the instant the forward end of the subsequent pipe enters the bending area, and to provide a sufficient gap between the forward end of the subsequent pipe and the tail end of the preceding pipe which is coiled, said gap being left to remove the coiled pipe. Furthermore, the known mill has been open to the objection that the rigidly fixed receiving rollers employ devices for removing the coiled pipe, said devices having an individual drive and a chain drive with grips that may deform the pipe as they return to the original position and also during entry between the turns of the preceding and subsequent coils.

SUMMARY OF THE INVENTION

It is a principal object of the invention to separate and remove a produced coil without interrupting a primary operation performed by a pipe-welding mill (longitudinal seam welding).

Another object of the invention is to simplify construction of a pipe-welding mill.

One more object of the invention is to enhance operational reliability of a pipe-welding mill.

The foregoing objects are accomplished by that in a pipe-welding mill for production of coiled pipes from rolled strip comprising a coil preparation section with unwinders disposed in a manner allowing displacement thereof in a direction perpendicular to the direction of pipe movement, and a magazine including a reel with set-up rolls, a strip coupler, shaping, welding, and drawing stands, a coiling arrangement with bending rollers, a receiving arrangement with guide or receiving rollers having a common drive with bending rollers, and a cutting arrangement, said components being successively installed in the direction of pipe movement, according to the invention, the cutting arrangement is placed behind the bending rollers of the coiling arrangement in the direction of a pipe turn, while the guide or receiving rollers of the receiving arrangement are mounted on a platform installed in a manner allowing it to tilt with respect to axes of the bending rollers, the receiving rollers being coupled to an output shaft of the common drive through a universal joint so that the receiving rollers can tilt with the platform.

It is of advantage that the cutting arrangement should comprise a stationary guide bush cutter passing a pipe and a movable cutter installed in a manner allowing its displacement with respect to an outlet of the bush cutter.

The pipe-welding mill for production of coiled pipes forming the subject of the present invention permits separation of a welded coil of desired size regardless of the length of the initial strip roll without interrupting a primary operation (longitudinal seam welding) and eliminates the necessity for providing intricate guides, feeding rollers, and a mechanism for controlling the bending roller at the instant the forward end of the subsequent pipe enters the bending area, the apparent advantages being simpler construction and maintenance of the mill, enhanced reliability of the various mechanisms, and ease in reloading the produced coil onto in-factory transfer facilities.

DETAILED DESCRIPTION OF THE DRAWINGS

The invention will now be described further with reference to a specific embodiment thereof, taken in conjunction with the accompanying drawings, wherein.

DESCRIPTION OF THE PREFERRED EMBODIMENT

Figure 1:
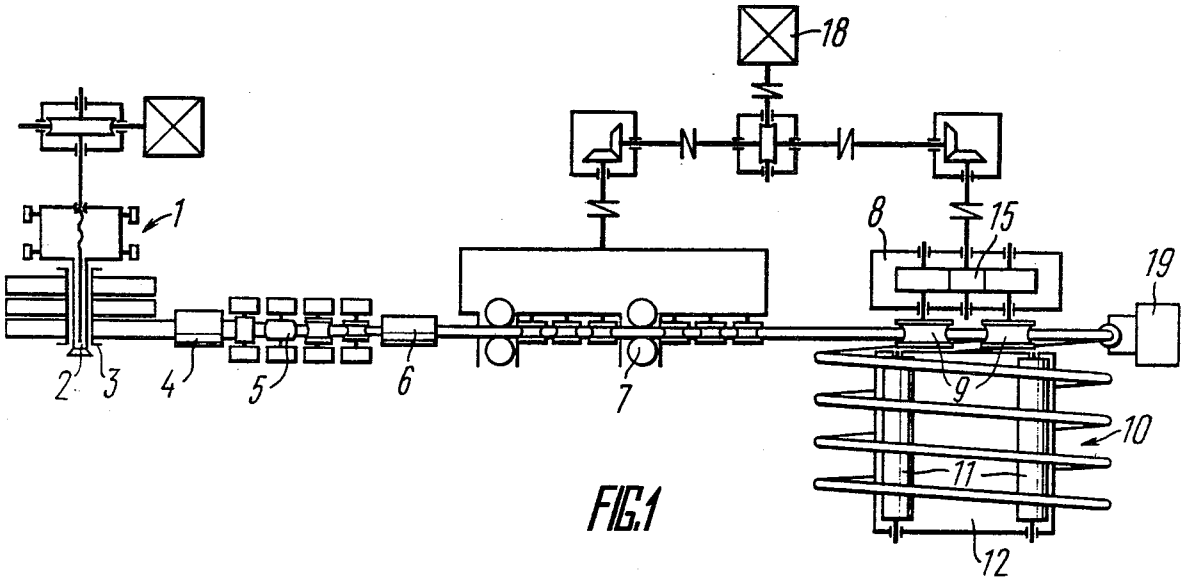
FIG. 1 is a plan view of a pipe-welding mill for production of coiled pipes.
Figure 2:
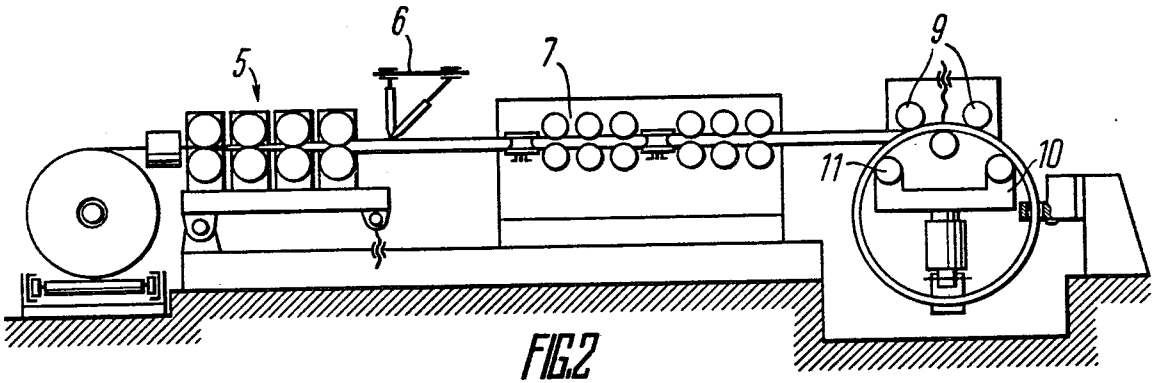
FIG. 2 is a front view of the embodiment of FIG. 1.
Figure 3:
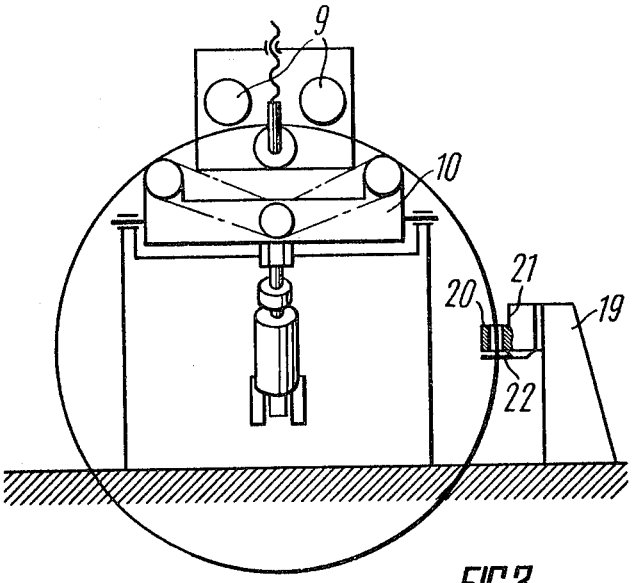
FIG. 3 is a side view of kinematic chains of coiling and illustrating the cutting and receiving arrangements of the mill.
Figure 4:
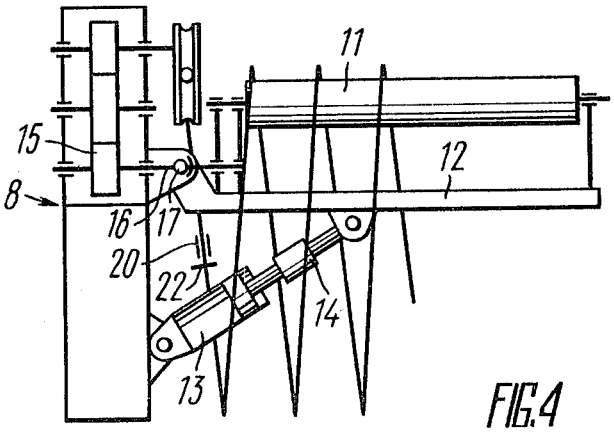
FIG. 4 is a front view of the arrangements of FIG. 3.

Referring to the drawings the pipe-welding mill forming the subject of the present invention comprises a coil preparation section 1 (FIGS. 1 and 2) with a console unwinder 2 disposed in a manner allowing its displacement in a direction perpendicular to the direction of pipe movement by a displacing mechanism shown schematically in FIG. 1, and a coil magazine representing a reel 3 with several coils arranged in parallel. The mill also includes the following components successively installed behind the preparation section 1 in the direction of pipe movement: a strip coupler 4, shaping stands 5 with non-driven shaping rollers, a welding stand 6, a drawing stand 7 with pairs of rollers contained in a common enclosure, said rollers having axes alternating in vertical and horizontal planes, a coiling arrangement 8 with bending rollers 9 (a three-roller bending machine in the preferred embodiment of the invention). The mill in accordance with the invention also comprises a receiving arrangement 10 with parallel receiving rollers 11 mounted on a platform 12 arranged in a manner allowing it to tilt with respect to the axes of the bending rollers 9 by the use of a tilting mechanism including an air cylinder 13 (FIG. 4) in the preferred embodiment of the invention, said cylinder being hinged to the frame of the coiling arrangement 8 and to the platform 12 through couplers and a pipe connector 14. The bending rollers 9 and the receiving rollers 11 have a common drive 15, the receiving rollers 11 being coupled to an output shaft 16 of the drive through a universal joint 17. The drawing stand 7 (FIG. 1) of the coiling arrangement 8 is driven by an electric motor 18 through a transmission drive. The hereinproposed mill also incorporates a cutting arrangement 19 (FIGS. 1 and 3) comprising a stationary guide bush cutter 20 mounted within an enclosure 21 (FIG. 3) and a movable cutter 22 arranged in a manner allowing its displacement perpendicular to the axis of the bush cutter 20 at the outlet thereof in the direction of pipe movement. The cutting arrangement 19 (FIGS. 1 and 2) is installed behind the bending rollers 9 in the direction of a pipe turn.

The mill forming the subject of the present invention operates in the following manner.

An end of the strip from one coil is unwound from the reel 3 mounted on the console of the unwinder 2 and fed through the strip coupler 4 to the shaping stands 5 wherein a pipe stock is formed. The pipe stock is then fed to the welding stand 6 wherein the strip edges are completely brought together and joined, for example, by argon-arc welding. The pipe stock is transferred within the mill by the rollers of the drawing stand 7. Having passed the drawing stand 7, the welded pipe is supplied to the bending rollers 9 of the coiling arrangement 8. The pipe end bent to form a turn is passed through the guide bush cutter 20 to the receiving rollers 11 of the receiving arrangement 10. As the pipe stock is welded, the rollers 11 receive pipe turns, and a coil is, subsequently, formed.

As the supply of the strip in the coil is exhausted, the welding is stopped, the unwinder 2 is moved by a displacing mechanism in a direction perpendicular to the direction of the mill axis over a distance divisible by the coil width whereupon the forward end of the strip from the next coil is fed to the coupler 4 and is joined to the tail end of the strip from the preceding coil after due preparation. Next, the pipe stock is welded again.

After the receiving rollers 11 store a predetermined number of turns, the movable cutter 22 is moved by an air cylinder (not shown in the drawing) to cut the turn of the pipe billet. Since the movable cutter 22 is placed at the outlet of the bush cutter 20 in the direction of a pipe turn and the cutting arrangement is installed behind the bending rollers 9, there is no need to thread again the pipe end into the bending rollers 9 of the coiling arrangement 8 and into the bush cutter 20. The cut turns of the produced coil are tilted by the air cylinder 13 together with the receiving rollers 11 and the platform 12 and are transferred, for example, to a tie beam of a factory crane. The receiving rollers 11 will, then, receive new turns of the coil being produced. As this happens, the pipe stock welding is not interrupted. The pipe-welding mill forming the subject of the present invention advantageously provides simpler construction and permits production and removal of coils without stopping the operation, another positive feature being elimination of the need to thread the forward end of the pipe into the coiling arrangement. The proposed mill features a smaller size and entails a simpler maintenance procedure.

What is claimed is:

1. In a pipe-welding mill for the production of coiled pipes from coiled strips including a coil preparation section; an arrangement for unwinding coils prepared in said section; means for displacing said arrangement in a direction perpendicular to the direction of movement of the pipe in said mill; a magazine including a reel containing said coils, said magazine being mounted on said unwinding arrangement; a strip coupler installed behind said coil preparation section in the direction of movement of the pipe; a shaping stand installed behind said strip coupler; a welding stand installed behind said shaping stand; a drawing stand installed behind said welding stand; a coiling arrangement installed behind said drawing stand in the direction of movement of the pipe, said coiling arrangement including bending rollers a receiving arrangement including receiving rollers; common drive means for driving both said bending and receiving rollers; and a cutting arrangement, the improvement comprising:

said receiving arrangement includes a platform mounted for tilting movement with respect to the axes of said bending rollers; means for tilting said platform; said receiving rollers of said receiving arrangement being mounted for rotation on said tiltable platform; universal joint means for coupling said receiving rollers to said common drive means of the bending rollers so that said receiving rollers tilt together with said platform; and wherein said cutting arrangement is installed behind said bending rollers in the path of a turn of the pipe being received in said receiving arrangement.

2. A pipe welding mill as claimed in claim 1, wherein said cutting arrangement comprises a stationary guide bush cutting having a bore through which the pipe turn passes, and a movable cutter mounted for displacement in a direction substantially perpendicular to the axis of said bush bore, said movable cutter being positioned downstream of said bush bore.

* * * * *